US005779088A

United States Patent [19]

Hornig

[11] Patent Number: 5,779,088

[45] Date of Patent: Jul. 14, 1998

[54] SEAL FOR UPWARD OPENING HOLLOW CONTAINERS

[76] Inventor: Wolfgang Hornig, Industriestrasse 10, D-69245 Bammental, Germany

[21] Appl. No.: 670,808

[22] Filed: Jun. 25, 1996

[30] Foreign Application Priority Data

Jun. 30, 1995 [DE] Germany ..... 295 10 691 U

[51] Int. Cl.[6] ..... B65D 17/34

[52] U.S. Cl. ..... 220/269; 220/258; 220/259

[58] Field of Search ..... 220/258, 259, 220/269

[56] References Cited

U.S. PATENT DOCUMENTS

| | | | |
|---|---|---|---|
| 3,951,331 | 4/1976 | Smith et al. | 220/258 X |
| 4,210,618 | 7/1980 | Piltz et al. | 220/258 X |
| 4,399,924 | 8/1983 | Nilsson | 220/257 |
| 4,986,465 | 1/1991 | Jacobsson et al. | 220/269 X |
| 5,069,372 | 12/1991 | Kawajiri | 220/269 X |
| 5,103,973 | 4/1992 | Sato | 220/270 |
| 5,199,618 | 4/1993 | Reil et al. | 220/269 X |

FOREIGN PATENT DOCUMENTS

| | | |
|---|---|---|
| 94 20 437 U | 3/1995 | Germany . |
| 295 04 615 U | 6/1995 | Germany . |

*Primary Examiner*—Stephen Cronin
*Attorney, Agent, or Firm*—Wigman, Cohen, Leitner & Myers P.C.

[57] ABSTRACT

The seal for upward opening hollow containers consists of a substantially circular inside cover, whose rim has along part of its circumference a raised area rising at an angle to the cover plane; the underside of the inside cover is connected with a vapor diffusion barrier which is provided with a tear perforation in the area of an opening in the inside cover.

4 Claims, 1 Drawing Sheet

SEAL FOR UPWARD OPENING HOLLOW CONTAINERS

BACKGROUND OF THE INVENTION

This innovation relates to a seal for upward opening hollow containers, in particular cans of all kinds and paper cups.

DE-GM 94 20 437 from the applicant has proposed a top having a substantially circular inside cover whose diameter matches the diameter of the upper side of the hollow container, its rim having along part of its circumference a raised area rising at an angle to the cover plane, being provided on its underside with a circumferential bead and having an opening, and an outside cover lying on part of the inside cover and having a downward directed hollow opening mandrel on its underside and above the opening in the inside cover, and being pivoted to the inside cover via an articulated axle.

Such a top is excellently suited for being mounted on commercial beverage cans sealed on all sides since it is easy and cheap to produce, permits the can to be opened with few actions and little effort, and permits hygienically unobjectionable consumption of the drink contained in the hollow container even when the surfaces of the can are dirty.

A further top in particular for upward opening beverage cans and paper cups is described in DE-GM 295 04 615 from the applicant, it likewise consisting of an inside cover with a raised area rising at an angle to the cover plane and an outside cover lying on part of the inside cover and having a downward directed opening mandrel on its underside and above the opening provided in the inside cover, the opening mandrel being surrounded by a concentric cap whose upper end is firmly connected with the inside cover.

This top provides an excellent, hygienically unobjectionable and airtight seal for beverage cans, paper cups and the like which are not sealed by an upper metal cover, while permitting hygienically unobjectionable consumption of the food contained in the hollow container, for example a drink.

The problem of the present innovation is to provide a seal for upward opening hollow containers, in particular cans of all kinds and paper cups, which has an even simpler structure and prevents the quality of the food kept in the hollow container, for example a nonalcoholic drink, from being impaired by external influences even after a long storage period, i.e. a period of more than eight months.

SUMMARY OF THE INVENTION

The seal of the invention is intended for use with upward opening hollow containers for foods and beverages, especially cans and paper cartons or cups. It includes a substantially circular inside cover having a diameter that matches the diameter of the hollow container at the upper end thereof, with a rim which has along a portion of its circumference a raised area that is angled upwardly from the plane of the inside cover within and toward the upper rim of the container to provide a lip for drinking from the container when the seal has been opened. The inside cover has a circular ring flange along its rim, and an opening through which food or beverage may be dispensed from the container after the seal has been broken. An outside cover resides on or within a portion of the inside cover and has a projection which is shaped to mate tightly with the opening of the inside cover. The outside cover is connected to the inside cover by an articulated axle or hinge that allows the outside cover to be swiveled through an angle of substantially 180° so that the projection may be moved out of and into the opening when the container is to be opened and re-sealed, respectively.

A vapor diffusion barrier in the form of a thin foil of suitable material is firmly fastened to the underside of the inside cover and across the opening therein. This barrier is also firmly fastened to the underside of the projection on the outside cover, which lies substantially flush with the underside of the inside cover. Hence, if the projection is either pulled out of or pushed deeper into the opening, the barrier will rupture along a preset preferential tear perforation or pattern. A circumferential groove in the lower end of the wall of the opening in the inside cover matches with and accepts a circumferential bead on the lower end of the wall of the projection so that the outside and inside covers may be resealed at the opening by pressing the projection into the opening until the bead enters the groove to retain the projection in place. A second circumferential groove in the upper end of the wall of the opening in the inside cover, parallel to the first groove, matches with and accepts a circumferential bead on the upper end of the wall of the projection so that the outside and inside covers may be held together by a press fit of the projection into the opening until both beads enter and engage their respective grooves.

The seal according to the innovation is simple in structure, cheap to produce and results in an absolutely gastight and liquid-tight seal of a hollow container provided therewith over a long period of time. The vapor diffusion barrier provided ensures that no external influences impair the quality of the food contained in the hollow container; it permits an overpressure or underpressure to be maintained in the container so that the food contained therein remains fresh until opening; after opening for consuming the food there is a temporary seal which keeps the partly consumed food edible or drinkable over a period of several days.

BRIEF DESCRIPTION OF THE DRAWING

In the following the innovation will be explained more closely with reference to the drawing showing an advantageous embodiment.

DESCRIPTION OF THE PREFERRED EMBODIMENT

Figure 1:
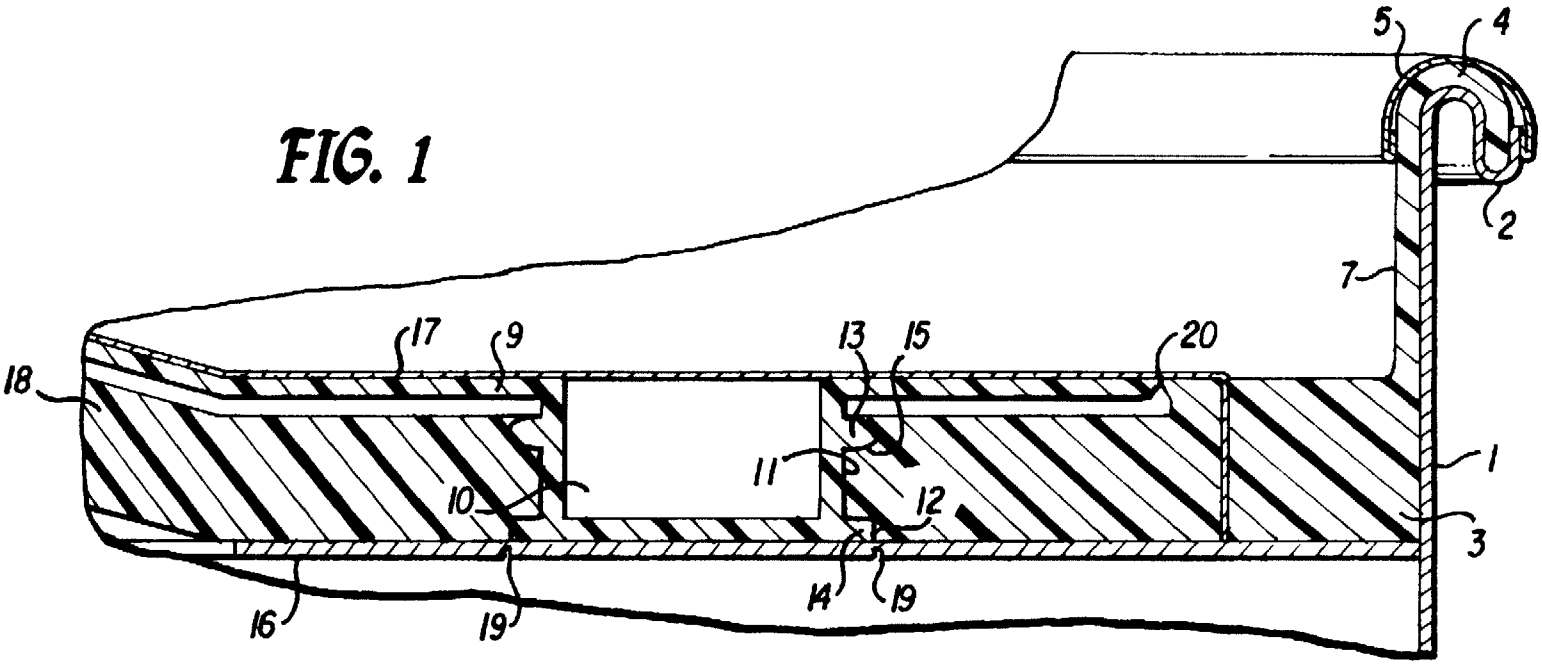
FIG. 1 shows a partial section through the seal according to the innovation with the essential parts.
Figure 2:
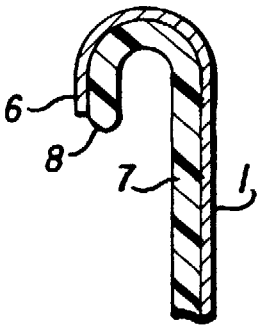
FIG. 2 shows a variant of the connection between seal and hollow container.

In the figures, 1 designates the vertical outer wall of an upward opening hollow container, for example a commercial beverage can, whose upper rim 2 can be turned outward once or twice (FIG. 1) or bent inward (FIG. 2). The seal according to the innovation consists of inside cover 3 which covers substantially the entire surface of circular beverage can 1 and is provided along its rim with circumferential ring flange 7 whose upper end 4 matches upper part 2 of the beverage can according to FIG. 1, end 4 being firmly folded and/or glued and/or thermoplastically welded to ring flange 7. Instead, the connection can also be provided by pressed-on circumferential clamping part 5 which connects flange 7 with the upper end of rim 2 of can 1. In the embodiment shown in FIG. 2, upper rim 6 of can 1 is arched inward and upper end 8 of ring flange 7 is seated as a snap in the bulge formed by rim 6.

As indicated on the left in FIG. 1, inside cover 3 is provided with raised area 18 rising at an angle, which extends over part of its outside rim and serves as a drinking lip after the seal is opened. Inside cover 3 is further provided with opening 11 which serves to empty the drink contained in can 1 after outside cover 9 is swiveled around articulated axle 20 provided in the inside cover.

Outside cover 9 is provided with projection 10 substantially filling entire opening 11, its underside being substantially flush with the underside of inside cover 3.

Opening 11 in inside cover 3 is further provided in its lower area with circumferential first groove 12 engaged by matched bead 14 surrounding the lower area of projection 10; second circumferential groove 15 parallel to first groove 12 can be provided in the wall of opening 11 above groove 12, whereby in this case second bead 13 extending parallel to first bead 14 is provided along the outside edge of projection 10. This design causes projection 10 to be held in a press fit in opening 11 in inside cover 3.

The entire underside of inside cover 3 including the area of opening 11 and thus also the underside of projection 10 are provided with vapor diffusion barrier 16 which is connected firmly with ring flange 7 of the seal and thus with the upper rim of the hollow container, i.e. can or paper cup 1. This vapor diffusion barrier made of a suitable material, for example metal or plastic, serves to keep the food contained in hollow container 1 fresh over a long period. In the area of opening 11 and thus of projection 10 inserted in opening 11, vapor diffusion barrier 16 is provided with preferably circular tear perforation 19 matching the circumference of the opening. Since the vapor diffusion barrier is connected firmly both with the inside cover and with the projection on the outside cover, the perforation can be separated by either pressing projection 10 into the interior of hollow container 1 by pressing on outside cover 9, or causing projection 10 to remove upward the part of the vapor diffusion barrier sticking thereto by swiveling outside cover 9 around articulated axle 20.

After vapor diffusion barrier 16 is opened by projection 10, the food, e.g. a drink, can be consumed via drinking lip 18 in a hygienically unobjectionable state. If one reseals opening 11 by projection 10 on outside cover 9, opened hollow container 1 will keep the remaining food contained therein fresh for several days or weeks.

Finally, 17 designates an outside layer substantially completely covering the upper side of at least outside cover 9 and serving as an advertising vehicle, on which a tear tab can also be provided for swiveling outside cover 9 around articulated axle 20.

I claim:

1. A seal for an upward opening hollow container, including a can or paper cup for holding food or beverage, having a substantially circular upper rim, the seal comprising a substantially circular inside cover having a diameter that closely matches the diameter of the upper rim of the container, the inside cover having an opening through which food or beverage may be dispensed from the container and being relatively planar except for a raised area along a portion of the circumference of the rim of said substantially circular inside cover which is angled upwardly from the plane of the inside cover within and toward the upper rim of the container to provide a lip for drinking from the container when the seal is opened; an outside cover on at least a portion of the inside cover and having a projection shaped to mate tightly with the opening in the inside cover, the outside cover being connected to the inside cover by an articulated hinge to allow the outside cover to be rotated through a sufficient angle so that the projection may be moved out of and into the opening when the container is to be opened and re-sealed, respectively; a vapor diffusion barrier comprising a thin foil of material firmly fastened to the underside of the inside cover and across the opening therein, and to the underside of the projection on the outside cover lying substantially flush with the underside of the inside cover when the container is originally sealed by said seal, so that the barrier material will rupture preferentially along the outline of the projection when the projection is pulled out of the opening; the lower end of the wall of the opening in the inside cover having a circumferential groove therein, and the lower end of the wall of the projection having a circumferential bead thereon that matches with and is accepted within the groove in the wall of the inside cover, so that the outside and inside covers may be resealed at the opening by pressing the projection into the opening until the bead enters the groove to retain the projection in place, and a second circumferential groove in the upper end of the wall of the opening in the inside cover, parallel to the first groove and a second circumferential bead on the upper end of the wall of the projection that matches with and is accepted by the second groove so that the outside and inside covers may be held together by a press fit of the projection into the opening until both beads enter and engage their respective grooves.

2. The seal of claim 1, wherein the inside cover has a circular ring flange along the rim thereof glued or welded to the upper rim of the hollow container.

3. The seal of claim 1, wherein the outside cover has an upper side with a coating serving as an advertising vehicle.

4. A seal for one end of a hollow container for holding food or beverage, said one end being relatively planar except for a raised area along a portion of the rim of the container at said one end which is angled upwardly from the plane of said one end within and toward said rim as a lip for drinking from the container when the seal is opened; said one end further having an opening through which food or beverage may be dispensed from the container; a cover for said opening, having a projection shaped to mate tightly with the opening, the cover being retained at said one end by an articulated hinge to allow the cover to be rotated through an angle of sufficient magnitude that the projection may be moved out of and into the opening when the container is to be opened and resealed, respectively; a vapor diffusion barrier comprising a thin foil of material firmly fastened to the underside of said one end and across the opening therein, and to the underside of the projection on the cover which is substantially flush with the underside of said one end when the container is originally sealed by said seal, so that the barrier material will rupture preferentially along the outline of the projection when the projection is first removed from the opening; a pair of spaced apart parallel grooves in the wall of the opening and a pair of spaced apart beads on the projection arranged and adapted to mate with said pair of spaced apart parallel grooves when the projection is in place in the opening, to secure said cover over the opening.

* * * * *